US006758904B2

(12) United States Patent
Parni et al.

(10) Patent No.: US 6,758,904 B2
(45) Date of Patent: Jul. 6, 2004

(54) BACKING LATH FOR A DOCTOR DEVICE

(75) Inventors: Petri Parni, Lahti (FI); Rami Vanninen, Kellokoski (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/381,917

(22) PCT Filed: Sep. 28, 2001

(86) PCT No.: PCT/FI01/00850

§ 371 (c)(1),
(2), (4) Date: Mar. 28, 2003

(87) PCT Pub. No.: WO02/27097

PCT Pub. Date: Apr. 4, 2002

(65) Prior Publication Data

US 2004/0040498 A1 Mar. 4, 2004

(30) Foreign Application Priority Data

Sep. 29, 2000 (FI) ..... 20002158

(51) Int. Cl.[7] ..... B05C 11/02

(52) U.S. Cl. ..... 118/126; 118/261; 118/413; 101/157; 101/169; 162/281

(58) Field of Search ..... 118/126, 261, 118/413; 427/355, 356; 15/256.5, 256.51; 101/157, 169

(56) References Cited

U.S. PATENT DOCUMENTS

| | | | | |
|---|---|---|---|---|
| 5,356,519 A | | 10/1994 | Grabscheid et al. | 162/281 |
| 5,624,495 A | | 4/1997 | Trefz et al. | 118/122 |
| 6,197,112 B1 | * | 3/2001 | Stotz et al. | 118/100 |

FOREIGN PATENT DOCUMENTS

| | | | |
|---|---|---|---|
| WO | WO 99/04091 A1 | 1/1999 | D21G/3/00 |
| WO | WO 00/28142 A1 | 5/2000 | D21H/23/58 |

* cited by examiner

*Primary Examiner*—Laura Edwards
(74) *Attorney, Agent, or Firm*—Cohen, Pontani, Lieberman & Pavane

(57) ABSTRACT

A backing lath (6, 14) used for coating a web of paper or paperboard in doctor blade and rod coaters and film-transfer coaters, the backing lath featuring a fiber-reinforced composite material body. When necessary, the backing lath can be surfaced with a wear-resistant coating. The invention also concerns a doctor element assembly, wherein the backing lath has a fiber-reinforced composite material body.

14 Claims, 1 Drawing Sheet

BACKING LATH FOR A DOCTOR DEVICE

PRIORITY CLAIM

This is a national stage of PCT application No. PCT/FI01/00850, filed on Sep. 28, 2001. Priority is claimed on that application and on Application No. 20002158 filed in Finland on Sep. 29, 2000.

BACKGROUND OF THE INVENTION

The present invention relates to a doctor element backing lath and doctor element assembly.

In the coating of paper and paperboard webs, to the surface of a moving web of paper is applied a layer of a coating mix, whereupon the coat is smoothed and the coating layer is doctored to a specified thickness by means of a doctor blade mounted on a support beam. The web to be coated passes through the nip formed between the doctor blade and a backing roll, whereby the blade doctors the excess coating off from the web surface and levels the remaining coating on the web surface into a layer of desired thickness. The doctor blade is loaded by means of backing lath adapted to rest against the blade either stiffly or flexibly. In a stiff loading assembly, the backing lath is adapted to rest directly on the blade, while in flexible loading there is adapted a flexible hose between the doctor blade and the backing lath.

To make the coating layer uniformly thick over its entire profile, the lineal loading force that pushes the doctor blade against the running web should be uniform over the entire width of the doctor blade. The doctor blade is loaded by moving the doctor blade support beam toward the backing roll, whereby the blade is compressed against the running web and bends about the loading line formed by the backing lath. Additionally, the doctor blade can be loaded locally by means of profile control screws that are adapted to effect on the backing lath and are placed over the cross-machine width of the web, typically at a distance of 45 to 150 mm from each other. The profile control screws make it possible to compensate, among other things, for defects in the base paper so that the defects will not be reflected on the profile of the coated web.

In most applications, the doctor blade may be replaced by a leveling rod assembly, wherein a rotating rod is used in lieu of a doctor blade. The rod of the leveling rod assembly is mounted on a holder having a flexible loading hose adapted thereagainst. Onto the other side of the loading hose is adapted a backing lath whose other side rests against the profile control screws.

Both in a leveling-rod assembly and a doctor blade assembly, even minimal deflections in the backing lath cause substantial deviations in the coat weight applied to the surface of the base web. A local deflection of the backing lath as small as about 0.075 mm causes a change of 1 to 2 $g/m^2$ in the coat weight. Today, backing laths are generally made by machining from tin-bronze material. As the ultimate yield strength of tin bronze is low, forces imposed thereon from the machining process, the profile control screws and thermal expansion can readily subject the backing lath to permanent deformations that are difficult to compensate for however close to each other the control screws are placed.

Due to the relatively high Young's modulus of tin bronze, a lot of force is required to bend such a backing lath, which means that the profile control screws must be placed maximally tightly pitched. However, rather small screws must be used to permit such a close spacing of the profile control screws.

Furthermore, tin bronze has a relatively high thermal expansion coefficient, whereby thermal expansion of the backing lath may cause deviations in the coat profile, particularly in the last coaters of a coater station and in coaters equipped with a so-called edge bead removal system that blows hot steam behind the doctor blade.

SUMMARY OF THE INVENTION

It is an object of the present invention to provide a novel type of doctor blade assembly capable of overcoming the above-described problems.

The goal of the invention is achieved by virtue of making the body of the backing lath from a fiber-reinforced composite material that has a high tensile strength, a low Young's modulus and suitable thermal expansion coefficient. The body of the backing lath can be surfaced with a coating material that is resistant to wear and environmental attack.

The invention offers significant benefits.

The Young's modulus of a backing lath made from a composite material is only about one-tenth of the Young's modulus of tin bronze, thus facilitating easier bending of the backing lath. Resultingly, the distance between the profile control screws can be made larger than in the prior art. Furthermore, a backing lath made from a composite material has no detectable ultimate yield strength, which means that the strip will not exhibit any permanent deformations due to yielding. Moreover, the tensile breaking strength of a composite material is manifold as compared to that of tin bronze. A backing lath made from a composite material is also free from permanent dimensional changes caused by thermal expansion. Additionally, the thermal expansion coefficient of the backing lath can be modified by proper alignment of fibers in the composite material. Herein, the thermal expansion coefficient of the backing lath is advantageously made equal to that of the framework of the doctor blade assembly, whereby it is possible to reduce the stresses imposed on the assembly from thermal expansion. A backing lath according to the invention can be made by pultrusion that is a dimensionally accurate method and offers low manufacturing costs once the investment in the molding die is covered. Additionally, the geometry of the backing lath can thus varied in a manner that is extremely difficult or even impossible to achieve by conventional machining techniques.

BRIEF DESCRIPTION OF THE DRAWINGS

In the following, the invention will be examined in more detail by making reference to the appended drawings in which.

DETAILED DESCRIPTION OF THE PRESENTLY PREFERRED EMBODIMENTS

Figure 1:
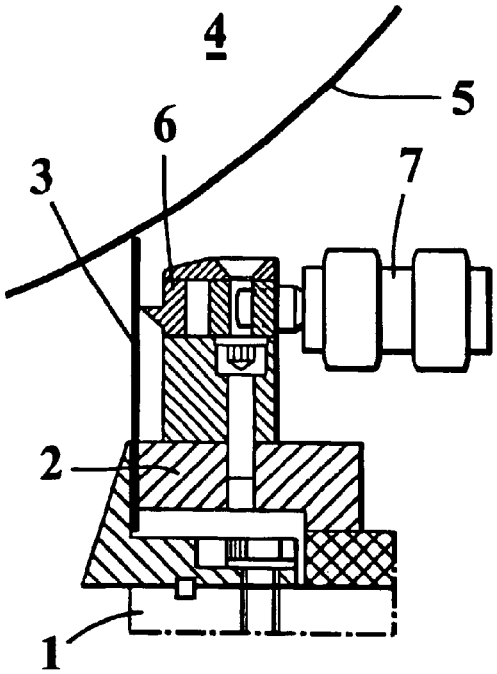
FIG. 1 shows a cross section of a stiffly loaded doctor blade.

In FIG. 1 is shown a conventional stiffly loaded doctor blade assembly comprising an elongated doctor blade support beam 1 extending over the cross-machine width of the coater and has adapted thereto a doctor blade holder 2. A doctor blade 3 extending over the entire cross-machine width of the web 5 is attached by its lower edge to the blade holder 2. The doctor blade 3 is loaded and its loading is controlled locally by pressing the doctor blade 3 with the help of profile control means, such as profile control screws 7, at a point above the mounting point of the blade holder 2 against the moving web 5 running about the backing roll 4. Between the doctor blade 3 and the profile control screws 7 is placed an elongated backing lath 6, whereto the ends of the profile control screws 7 are connected. The profile control screws 7 are located in the cross-machine direction over the width of the web 5 at a distance from each other. The spacing between the adjacent profile screws 7 is typically 45 to 150 mm.

Figure 2:
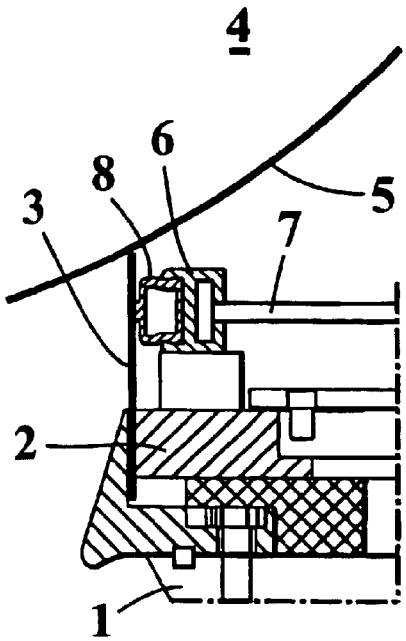
FIG. 2 shows a cross section of a flexibly loaded doctor blade.

In FIG. 2 is shown a conventionally flexibly loaded doctor blade assembly having a construction and operating principle otherwise similar to the stiffly loaded doctor blade shown in FIG. 1 with the exception that a flexible rubber hose 8 is adapted between the backing lath 6 and the doctor blade 3. One side of the backing lath 6 is connected to the profile control screws 7 and the other to the flexible rubber hose 8.

Figure 3:
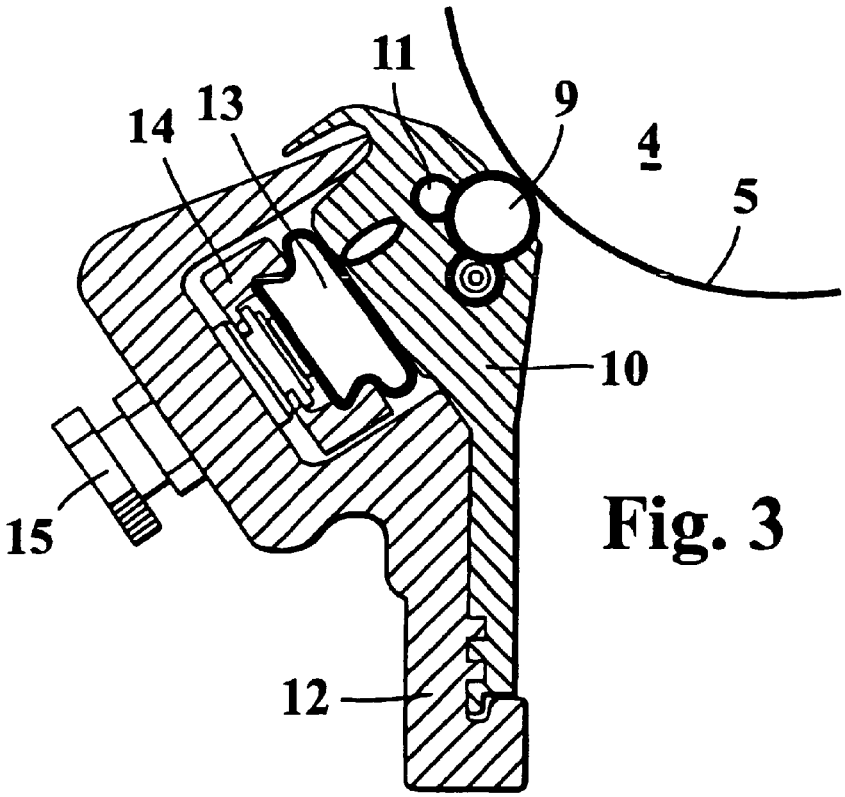
FIG. 3 shows a cross section of a flexibly loaded leveling rod assembly.

In FIG. 3 is shown a conventional leveling rod assembly, wherein a leveling rod 9 extending over the entire cross-machine width of the web 5 to be coated rotates in a cradle 11 formed into a rod holder 10. The rod holder 10 is mounted on the framework 12 of the leveling rod assembly, and a flexible rubber hose 13 is placed between the rod holder 10 and the framework 12 so that one side of the hose rests against the rod holder 10 and the other side of the hose is adhered to a backing lath 14. The leveling rod 9 can be loaded locally by compressing the backing lath 14 with profile control means 15 that are located at a distance from each other over the cross-machine width of the web 5 running about a backing roll 4. From these control means the loading force is transmitted via the backing lath 14 and the flexible rubber hose 13 to the leveling rod 9.

The embodiments illustrated in FIGS. 1, 2 and 3 include a backing lath 6, 14 formed by a fiber-reinforced composite body. The fibers are advantageously selected from the group of glass, carbon, boron or aramide fibers or combinations thereof. Advantageously, epoxy resin is used as the matrix of the composite material from which the body of the backing lath 6, 14 is made. The composite-material body is surfaced with a coating composition that is resistant to wear and environmental conditions. Advantageously, the surface is coated with hard chromium. The surface coating may be applied by means of, e.g., thermal spraying or physical gas-phase deposition techniques.

Advantageously, the Young's modulus of the composite material body of the backing lath 6, 14 is smaller than 50 GPa, whereby the backing lath 6, 14 becomes easily bendable. Typically, the tensile breaking strength of the backing lath 6, 14 in its longitudinal direction is greater than 500 MPa. Further advantageously, the thermal expansion coefficient of the composite material used in the body of the backing lath 6, 14 is at least substantially equal to that of the doctor unit framework 1, 12, whereby no stresses are imposed on the framework structure from thermal expansion. The thermal expansion coefficient of the composite material and the longitudinal Young's modulus of the backing lath 6, 14 can be modified during the manufacturing stage by placing oriented fiber bunches in the structure. Also the number of fibers used in the structure affects the characteristics discussed above. Typically, the thermal expansion coefficient of the composite material is from 0 to $20 \cdot 10^{-6} K^{-1}$. The composite body of the backing lath 6, 14 can be made by pultrusion, for instance, whereby the body becomes dimensionally precise and can be given shapes that are difficult to manufacture by machining.

In addition to those described above, the invention may have alternative embodiments. For instance, the backing lath according to the invention may also be used in a leveling rod or doctor blade unit adapted to smooth the coating mix layer applied to the roll of a film-transfer coater.

What is claimed is:

1. A backing lath for a doctor element assembly used in the coating of a paper or paperboard web, the backing lath being shaped to be positioned between a doctor element and a profile control means, the backing lath being comprised of a fiber-reinforced composite body.

2. The backing lath of claim 1 having a coating durable against wear.

3. The backing lath of claim 1, wherein a Young's modulus of the backing lath is smaller than 50 GPa.

4. The backing lath of claim 1, wherein a tensile breaking strength of the backing lath in a longitudinal direction is greater than 500 MPa.

5. The backing lath of claim 1, wherein a thermal expansion coefficient of the backing lath is at least equal to that of framework into which the doctor unit is mounted.

6. The backing lath of claim 2, wherein the coating is comprised of hard chromium.

7. The backing lath of claim 1, wherein the backing lath fiber-reinforced composite body comprises at least one of glass and carbon fiber.

8. The backing lath claim 1, wherein a matrix of the backing lath fiber-reinforced composite body comprises epoxy resin.

9. The backing lath claim 7, wherein a matrix of the backing lath fiber-reinforced composite body comprises epoxy resin.

10. The backing lath of clam 1 made by pultrusion.

11. The backing lath claim 1, wherein the fiber-reinforced composite body has no ultimate yield strength.

12. A doctor element assembly suitable for controlling an amount of coating mix applied to a moving web or a roll of a film-transfer coater and for leveling the applied coating mix layer, the assembly comprising:

a framework having a holder mounted thereon;

a doctor element mounted on said holder;

a profile control means positioned for compressing said doctor element against a surface of said web or said roll of said film-transfer coater; and a backing lath between said doctor element and said profile control means, said backing lath being comprised of a fiber-reinforced composite body.

13. The doctor element assembly of claim 12, further comprising a flexible hose positioned between said backing lath and said doctor element.

14. The doctor element assembly of claim 12, further comprising a flexible hose positioned between said framework and said profile control means.

* * * * *